US006876282B2

(12) United States Patent
Andricacos et al.

(10) Patent No.: US 6,876,282 B2
(45) Date of Patent: Apr. 5, 2005

(54) MICRO-ELECTRO-MECHANICAL RF SWITCH

(75) Inventors: Panayotis Constantinou Andricacos, Croton-on-Hudson, NY (US); L. Paivikki Buchwalter, Hopewell Junction, NY (US); Hariklia Deligianni, Tenafly, NJ (US); Robert A. Groves, Highland, NY (US); Christopher Jahnes, Upper Saddle River, NJ (US); Jennifer L. Lund, Brookeville, MD (US); Michael Meixner, Erlangen (DE); David Earle Seeger, Congers, NY (US); Timothy D. Sullivan, Underhill, VT (US); Ping-Chuan Wang, Hopewell Junction, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/150,285

(22) Filed: May 17, 2002

(65) Prior Publication Data

US 2003/0214373 A1 Nov. 20, 2003

(51) Int. Cl.[7] ..... H01H 51/22
(52) U.S. Cl. ..... 335/78; 200/181

(58) Field of Search ..... 335/78–86, 128; 200/181; 257/404–427; 361/233–234; 333/262

(56) References Cited

U.S. PATENT DOCUMENTS 5,880,921 A * 3/1999 Tham et al. ..... 361/233
6,422,077 B1 * 7/2002 Krauss et al. ..... 73/514.25
6,531,947 B1 * 3/2003 Weaver et al. ..... 337/139

* cited by examiner

*Primary Examiner*—Lincoln Donovan
(74) *Attorney, Agent, or Firm*—Scully, Scott, Murphy & Presser; Robert M. Trepp, Esq.

(57) ABSTRACT

A microelectromechanical switch including: at least one pair of actuator electrodes; at least one input electrode and at least one output electrode for input and output, respectively, of a radio frequency signal; and a beam movable by an attraction between the at least one pair of actuator electrodes, the movable beam having at least a portion electrically connected to the at least one input electrode and to the at least one output electrode when moved by the attraction between the at least one pair of actuator electrodes to make an electrical connection between the at least one input and output electrodes; wherein the at least one pair of actuator electrodes are electrically isolated from each of the at least one input and output electrodes. The microelectromechanical switch can be configured in single or multiple-poles and/or single or multiple throws.

9 Claims, 13 Drawing Sheets

MICRO-ELECTRO-MECHANICAL RF SWITCH

BACKGROUND OF THE INVENTION

1. Field of the Invention

The present invention relates generally to RF switches, and more particularly, to single-pole, multi-throw (micro-electro-mechanical) MEMS RF switches.

2. Prior Art

MEMS switches are called as such because they use electrostatic actuation to create movement of a beam or membrane that results in an- ohmic contact (i.e. an RF signal is allowed to pass-through) or by a change in capacitance by which the flow of signal is interrupted and typically grounded.

In a wireless transceiver, pin diodes or GaAs MESFET's are used as switches. However, these have high power consumption rates, high losses (typically 1 dB insertion loss at 2 GHz), and are non-linear devices. MEMS switches on the other hand, have demonstrated insertion loss of less than 0.5 dB, are highly linear, and have very low power consumption since they use a DC voltage for electrostatic actuation. If the actuators are coupled to the RF signal in a series switch, then the DC bias would need to be decoupled from the RF signal. Usually, the DC current for the pin diodes in conventional switches is handled in the same way. Decoupling is never 100% and there are always some losses to the RF signal power either by adding resistive losses or by direct leakage. Another source of losses is capacitive coupling of actuators to the RF signal (especially when a series switch is closed). If high power is fed through the switch, then a voltage drop of about 10V is associated with the RF signal. That voltage is present at the RF electrode of the series switches in the open state. If these electrodes are also part of the closing mechanism (by comprising one of the actuator electrodes) that could cause the switches to close and thus limit the switch linearity (generate harmonics etc.). Usually transistor switches such as CMOS or FET suffer from non-linearity and high losses.

U.S. Pat. No. 5,619,061 to Goldsmith et al. has shown designs of MEMS switches comprised of metal and dielectric films for both capacitive coupling and ohmic contact but the metal films and the designs proposed by their invention rely on thin metal films either on top or below a beam made out of a dielectric material. A disadvantage of this type of switch is that unless the beam is made out of a single metal, there is no effective heat dissipation mechanism due to the Joule heating effect generated by the a high power RF signal that may go through.

SUMMARY OF THE INVENTION

Therefore, it is an object of the present invention to provide a single-pole, multi-throw MEMS RF switch that minimizes losses and improves on switch linearity as compared to the MEMS RF switches of the prior art.

It is another object of the present invention to provide a single-pole, multi-throw MEMS RF switch that improves heat dissipation as compared to the MEMS RF switches of the prior art.

Accordingly, a microelectromechanical switch is provided. The microelectromechanical switch comprises: at least one pair of actuator electrodes; at least one input electrode and at least one output electrode for input and output, respectively, of a radio frequency signal; and a beam movable by an attraction between the at least one pair of actuator electrodes, the movable beam having at least a portion electrically connected to the at least one input electrode and to the at least one output electrode when moved by the attraction between the at least one pair of actuator electrodes to make an electrical connection between the at least one input and output electrodes; wherein the at least one pair of actuator electrodes are electrically isolated from each of the at least one input and output electrodes.

Also provided is a microelectromechanical switch comprising: a first level portion having a first electrode for input or output of a radio frequency signal, at least one first actuator electrode electrically isolated from the first electrode, and a first contact electrically cooperating with the first electrode; and a second level portion having at least a portion separated from the first level portion by an air gap, the second level portion having a deflective beam capable of deflecting into the air gap, the beam having at least one second actuator electrode corresponding to the at least one first actuator electrode, the beam further having a second electrode corresponding to the first electrode for the other of the input or output of the radio frequency signal and a second contact electrically cooperating with the second electrode, the at least one second attractive electrode being electrically isolated from the second electrode; wherein creation of an electrical attraction between the at least one first and second actuator electrodes causes the beam to deflect into the air gap and to provide an electrical connection between the first and second contacts and their respective first and second electrodes for allowing the input radio frequency signal to one of the first and second electrodes to be output to the other of the first and second electrodes.

Preferably, the at least one first actuator electrode comprises two first actuator electrodes each of which are electrically isolated from the first electrode and wherein the at least one second actuator electrode comprises two second actuator electrodes, each of the two first actuator electrodes corresponding to a respective second actuator electrode when the beam is deflected into the air gap.

The microelectromechanical switch preferably further comprises at least one bumper arranged on the first level portion adjacent the first contact for urging contact between the first and second contacts when the beam is deflected into the air gap. More preferably, the at least one bumper comprises first and second bumpers, each of which is arranged on the first level portion adjacent the first contact for urging contact between the first and second contacts when the beam is deflected into the air gap.

Preferably, the creation of an electrical attraction between the first and second actuator electrodes comprises means for maintaining one of the first and second actuator electrodes at a ground state and the other of the first and second actuator electrodes energized with an applied voltage.

The beam preferably further having a plurality of access holes formed therein for facilitating creation of the air gap and for minimizing air damping during switch operation.

The first and second level portions preferably have a width and wherein at least one of the first and second electrodes is aligned in the direction of the width and has a first dimension in the direction of the width which is less than the width. More preferably, each of the first and second electrodes are aligned in the direction of the width and each has the first dimension in the direction of the width which is less then the width. In which case, the microelectromechanical switch preferably further comprises at least one dummy conductor disposed in the direction of the width and electrically isolated from a corresponding first and/or second electrode, the dummy conductor having a second dimension in the direction of the width which is less than the difference between the width and the first dimension.

Preferably, at least one of the first and second actuator electrodes are rectangular and wherein at least a portion of the first and second actuator electrodes correspond with each other across the air gap. More preferably, each of the first and second actuator electrodes comprises two first and second actuator electrodes, each of which are rectangular and disposed on both sides of their corresponding first and second electrodes.

The microelectromechanical switch of claim 1, wherein at least one of the second actuator electrodes are triangular having a base and an apex and wherein at least a portion of the first and second actuator electrodes correspond with each other across the air gap. Preferably, each of the first and second actuator electrodes comprises two first and second actuator electrodes, disposed on both sides of their corresponding first and second electrodes. More preferably, the base of each of the second actuator electrodes is proximate the second electrode.

Preferably, the microelectromechanical switch of claim 1, further comprising a ground plate electrically connected to one of the first or second actuator electrodes for grounding one of the first or second actuator electrodes.

Still provided is a multiple throw microelectromechanical switch comprising two or more single throw microelectromechanical switches. Each of the single throw microelectromechanical switches comprising: a first level portion having a first electrode for input or output of a radio frequency signal, at least one first actuator electrode electrically isolated from the first electrode, and a first contact electrically cooperating with the first electrode; and a second level portion having at least a portion separated from the first level portion by an air gap, the second level portion having a deflective beam capable of deflecting into the air gap, the beam having at least one second actuator electrode corresponding to the at least one first actuator electrode, the beam further having a second electrode corresponding to the first electrode for the other of the input or output of the radio frequency signal and a second contact electrically cooperating with the second electrode, the at least one second attractive electrode being electrically isolated from the second electrode; wherein creation of an electrical attraction between the at least one first and second actuator electrodes causes the beam to deflect into the air gap and to provide an electrical connection between the first and second contacts and their respective first and second electrodes for allowing the input radio frequency signal to one of the first and second electrodes to be output to the other of the first and second electrodes.

The multiple throw microelectromechanical switch preferably further comprises a ground plate electrically connected to one of the first or second actuator electrodes for each of the single throw microelectromechanical switches for grounding the one of the first or second actuator electrodes. The multiple throw microelectromechanical switch more preferably further comprises a substrate upon which is disposed one of the first or second level portions for each of the single throw microelectromechanical switches. The ground plate is preferably a continuous solid plate disposed on a lower surface of the substrate. Where the multiple throw microelectromechanical switch further comprises radio frequency input and output lines disposed on the substrate, one of which is connected to one of the first or second electrodes of each of the single throw microelectromechanical switches and the other of which is connected to the other of the first second electrodes of each of the single throw microelectromechanical switches, the ground plate is alternatively disposed on a lower surface of the substrate only in portions corresponding to the single throw microelectromechanical switches and the radio frequency input and output lines.

Still yet provided is a multiple throw microelectromechanical switch comprising two or more single throw microelectromechanical switches. Each of the single throw microelectromechanical switches comprises: at least one pair of actuator electrodes; at least one input electrode and at least one output electrode for input and output, respectively, of a radio frequency signal; and a beam movable by an attraction between the at least one pair of actuator electrodes, the movable beam having at least a portion electrically connected to the at least one input electrode and to the at least one output electrode when moved by the attraction between the at least one pair of actuator electrodes to make an electrical connection between the at least one input and output electrodes; wherein the at least one pair of actuator electrodes are electrically isolated from each of the at least one input and output electrodes.

BRIEF DESCRIPTION OF THE DRAWINGS

These and other features, aspects, and advantages of the apparatus and methods of the present invention will become better understood with regard to the following description, appended claims, and accompanying drawings where:

FIG. 5 illustrates a preferred MEMS RF switch where the RF signal line is composed of two metal segments with a small thickness dielectric in between.

DETAILED DESCRIPTION OF THE PREFERRED EMBODIMENT

Figure 1A:
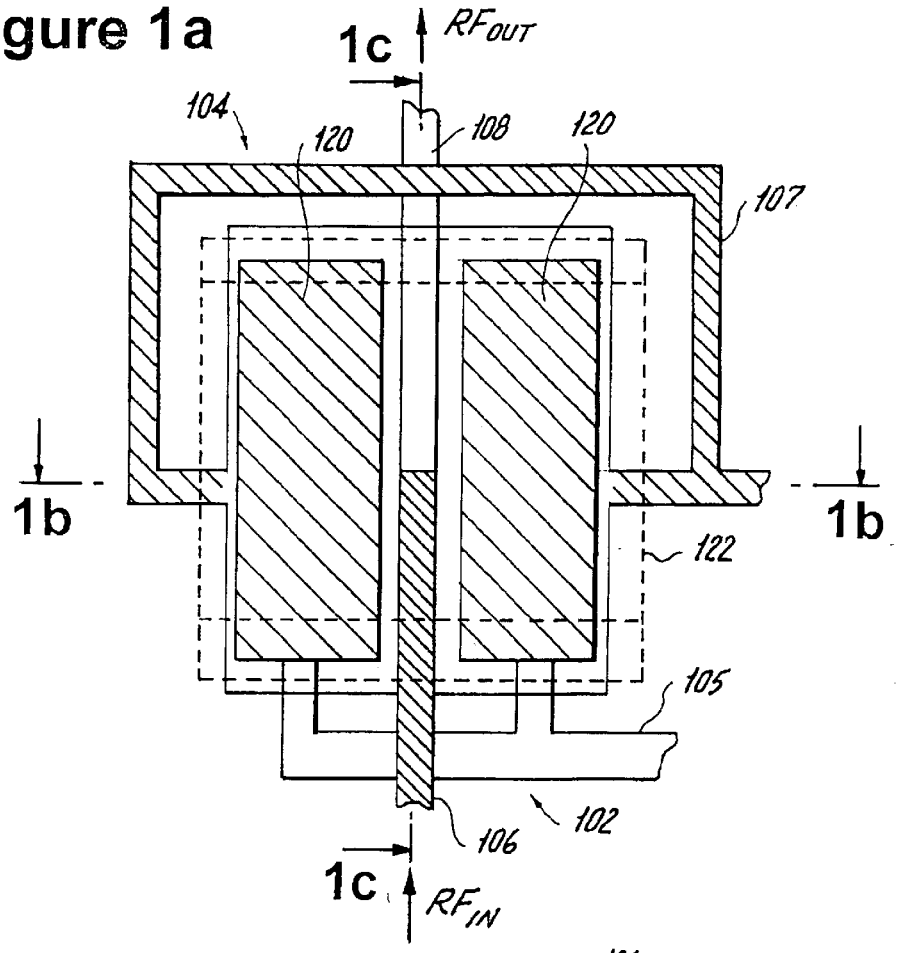
FIG. 1*a* illustrates a top view of a preferred single-pole single-throw MEMS RF switch having a single contact.
Figure 1B:
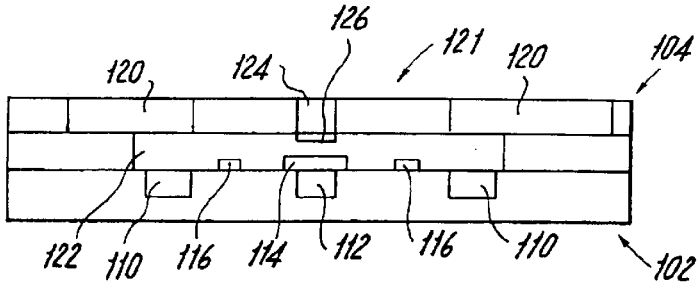
FIG. 1*b* illustrates a sectional view of the switch of FIG. 1*a* taken along line 1*b*—1*b* thereof.
Figure 1C:
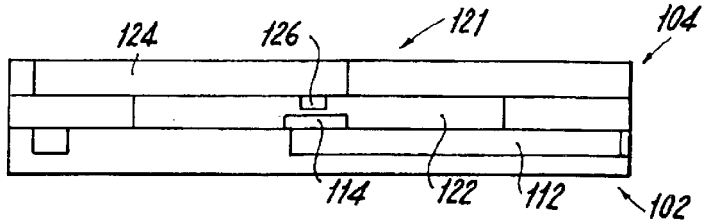
FIG. 1*c* illustrates a sectional view of the switch of FIG. 1*a* taken along line 1*c*—1*c* thereof.

Referring now to FIGS. 1*a*, 1*b*, and 1*c* there is illustrated a single-contact MEMS, generally referred to by reference numeral 100. The single contact MEMS 100 is electrostatically activated as will be described below. Although the MEMS switch 100 illustrated in FIGS. 1*a*, 1*b*, and 1*c* is a single-pole, single-throw switch, such is given by way of example only and not to limit the scope or spirit of the present invention. Those skilled in the art will realize that multiple pole and/or multiple-throw configurations are also possible, as described below.

Referring to FIG. 1*a*, a top schematic view of the MEMS 100 is shown in which a first level portion 102 of the switch 100 is shown with solid areas while a second level portion 104 is shown with hatched areas. In the preferred implementation of the switch 100, the first level portion 102 is a lower level, while the second level portion 104 is an upper level portion. However, those skilled in the art will appreciate that the switch 100 can be configured with the first and second level portions 102, 104 oriented in any manner. The switch further has radio frequency (RF) input and output lines 106, 108. The RF input line 106 is shown as inputting the upper level portion 104 and the RF output line 108 is shown as being output from the lower level portion 102. However, those skilled in the art will appreciate that the switch 100 can be configured in the reverse orientation (i.e., the RF input line 108 is inputted into the lower level portion 102 and the RF output line 106 is output from the upper level portion 104).

Referring now to FIGS. 1*b* and 1*c* there is illustrated a cross-section of the switch 100 of FIG. 1*a* as taken along line 1—*1b* and 1*c*—1*c* respectively. The lower level portion 102 consists of at least one, and preferably two lower actuator electrodes 110. The lower actuator electrodes 110 are typically kept at ground potential. The lower level portion 102 further has a lower electrode 112 which acts to input or output the RF signal from the RF input or output lines 106, 108. As illustrated, the lower electrode 112 is electrically connected to the RF output line 108. The lower actuator electrodes 110 are completely electrically isolated from the lower electrode 112. Those skilled in the art will appreciate that the separation of the actuator electrodes 110 from the lower electrode which carries the RF signal results in minimizing losses and improving the switch linearity.

A first contact 114 is provided and is electrically connected to the lower electrode 112. The first contact 114 is raised above the top surface of the lower actuator electrodes 110 and first electrode 112. At least one bumper and preferably two bumpers 116 are disposed above the top surface of the lower actuator electrodes 110 and first electrode 112 and are not necessarily made out of metal and are electrically isolated from the other electrodes 110, 112. As will be discussed below, the bumpers 116 act to prevent stiction between the upper contact 126 and the lower contact 114. The above-described elements of the lower level portion 102 are formed on a substrate (not shown) by etching and deposition methods known in the art.

The upper level portion 104 includes a movable beam 121, which in the preferred implementation of FIGS. 1*a*, 1*b*, and 1*c* moves by deflecting or bowing towards the lower level portion 102. The beam 121 comprises upper actuator electrodes 120 which correspond to the lower actuator electrodes 110 across an air gap 122. The air gap 122 is represented in FIG. 1*a* by a dotted line, which is referenced with reference numeral 122. The upper actuator electrodes 120 are preferably rectangular in shape, as are the lower actuator electrodes 110, and at least a portion corresponds or overlaps with the lower actuator electrodes 110. As discussed above with regard to the lower actuator electrodes 110 and lower electrode 112, the upper actuator electrodes 120 and upper electrode 124 are completely electrically isolated from each other. Thus, for the same reason as discussed above, the separation of the actuator electrodes 120 from the upper electrode 124 which carries the RF signal results in minimizing losses and improving the switch linearity.

While the lower actuator electrodes 110 are preferably held at a ground potential, the upper actuator electrodes 120 are preferably and selectively held at contact voltage V1, to create an attractive electrostatic force between the beam 121 and the lower actuator electrodes 110 that are at ground. The beam 121 further has a upper electrode 124 for carrying the RF signal, which in the preferred implementation illustrated in FIGS. 1*a*, 1*b*, and 1*c* is the RF input signal from the RF input line 106. An upper contact 126 is provided which is electrically connected to the upper electrode 124 and is extended into the air gap 122.

The MEMS 100 also includes voltage potential lines 105, 107 to create an electrostatic attraction between the first and second actuator electrodes. As discussed above, the lower actuation electrodes 110 are preferably maintained at a ground potential by connecting voltage potential line 105 to a ground while the upper actuator electrodes 120 are selectively held at a contact voltage V1 by connecting voltage potential line 107 to a power (voltage) source. In operation, when an electrostatic attraction is created between the upper and lower actuator electrodes 110, 120, the beam 121 bends or deflects towards the lower level portion 102 and the upper contact 126 touches the lower contact 114 and allows an RF signal go through from the input line 106 to the output line 108. The bumpers 116 act to prevent stiction between contacts 124 and 114 and also act to prevent shorting of the beam 100 to actuators 110. As discussed previously, the configuration of the MEMS 100 illustrated in FIGS. 1*a*, 1*b*, and 1*c* has the actuation DC electrodes 110, 120 entirely separated from the AC RF signal electrodes 112, 124 resulting in minimizing losses and improving the switch linearity.

Figure 2:
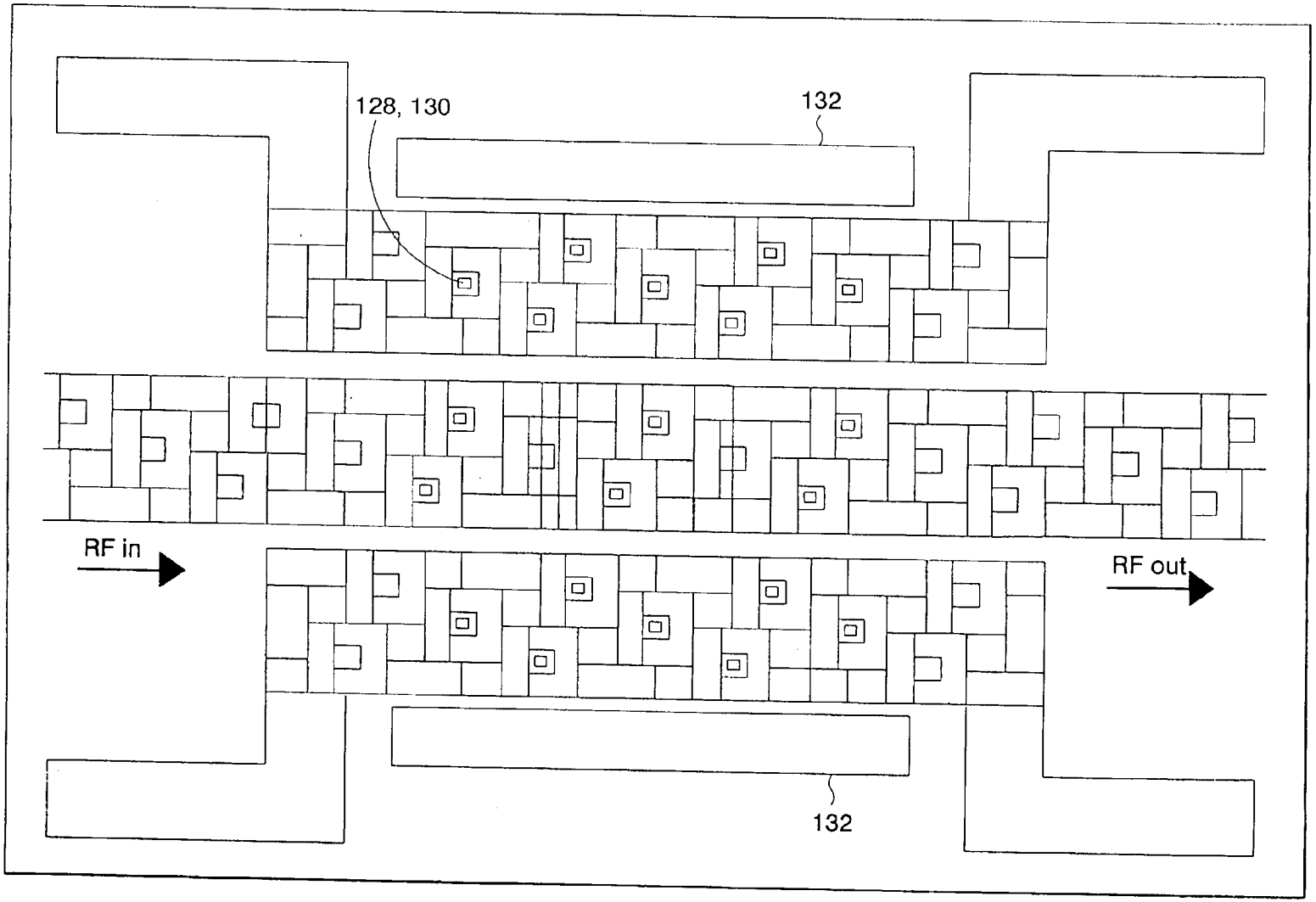
FIG. 2 illustrates a top view of the switch of FIG. 1*a* showing access holes on the beam thereof.

Referring now to FIG. 2, there is shown a top view of the MEMS 100, and in particular beam 121 having access holes 128 to facilitate easier removal of a sacrificial layer in order to create the air gap 121. The access holes 128 are preferably 2×2 micron insulator plugs, having 1×1 micron etch holes 130 which are cut within the 2×2 um plugs. Access slots 132 are also provided and used for etching the sacrificial material.

Figure 3A:
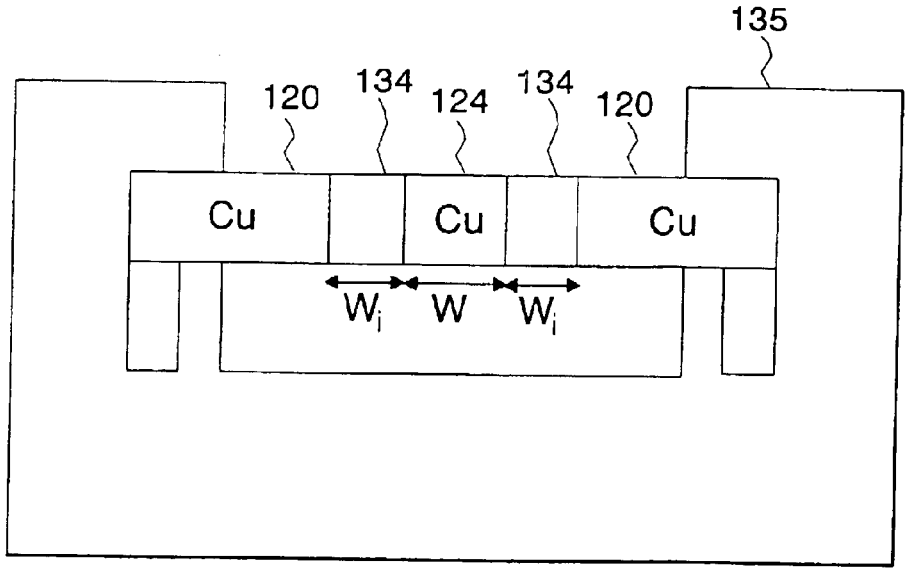
FIGS. 3*a* and 3*b* illustrate a sectional view of a MEMS switch and a graph, respectively, showing the Joule heating results thereof.
Figure 3B:
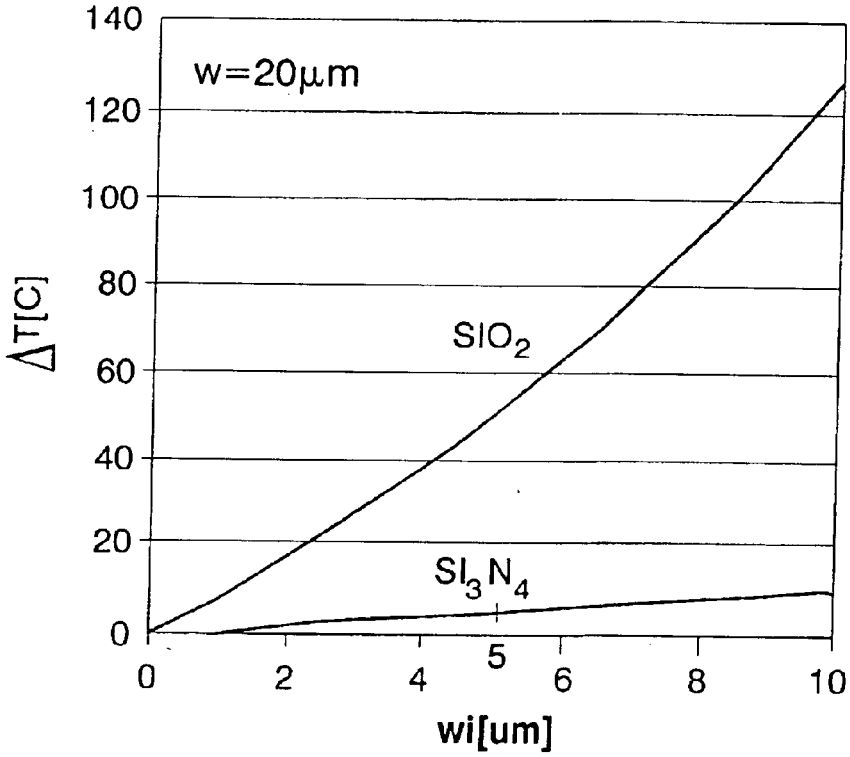

Referring now to FIGS. 3*a* and 3*b*, there is described results of a Joule heating model. When 1–4 Watts of RF power are passed through the MEMS switch 100 at the upper electrode 124, there is a lot of heat generated that needs to be dissipated to the surrounding substrate 135, which is preferably Si. Although only shown with regard to the upper level portion 104, the upper actuator electrodes 120, and upper electrode 124, a similar analysis is applicable to the lower level portion 102, the lower actuator electrodes 110 and lower electrode 112. The model shown in FIG. 3*a* assumes that the second electrode 124 (or first electrode 112) is copper and that its width (w) is 20 microns. The graph shown in FIG. 3*b* shows the temperature rise as a function of the insulator width ($w_1$) for the case of a copper second electrode 124 and for two different insulator 134 materials, namely silicon dioxide and silicon nitride. It is apparent from the model that the insulator width ($w_i$) needs to be kept below 6 microns, and preferably at about 5 microns for effective heat dissipation. Although either silicon nitride or silicon dioxide can be used, it is apparent that silicon nitride is more effective than silicon dioxide to dissipate the released heat.

Figure 4:
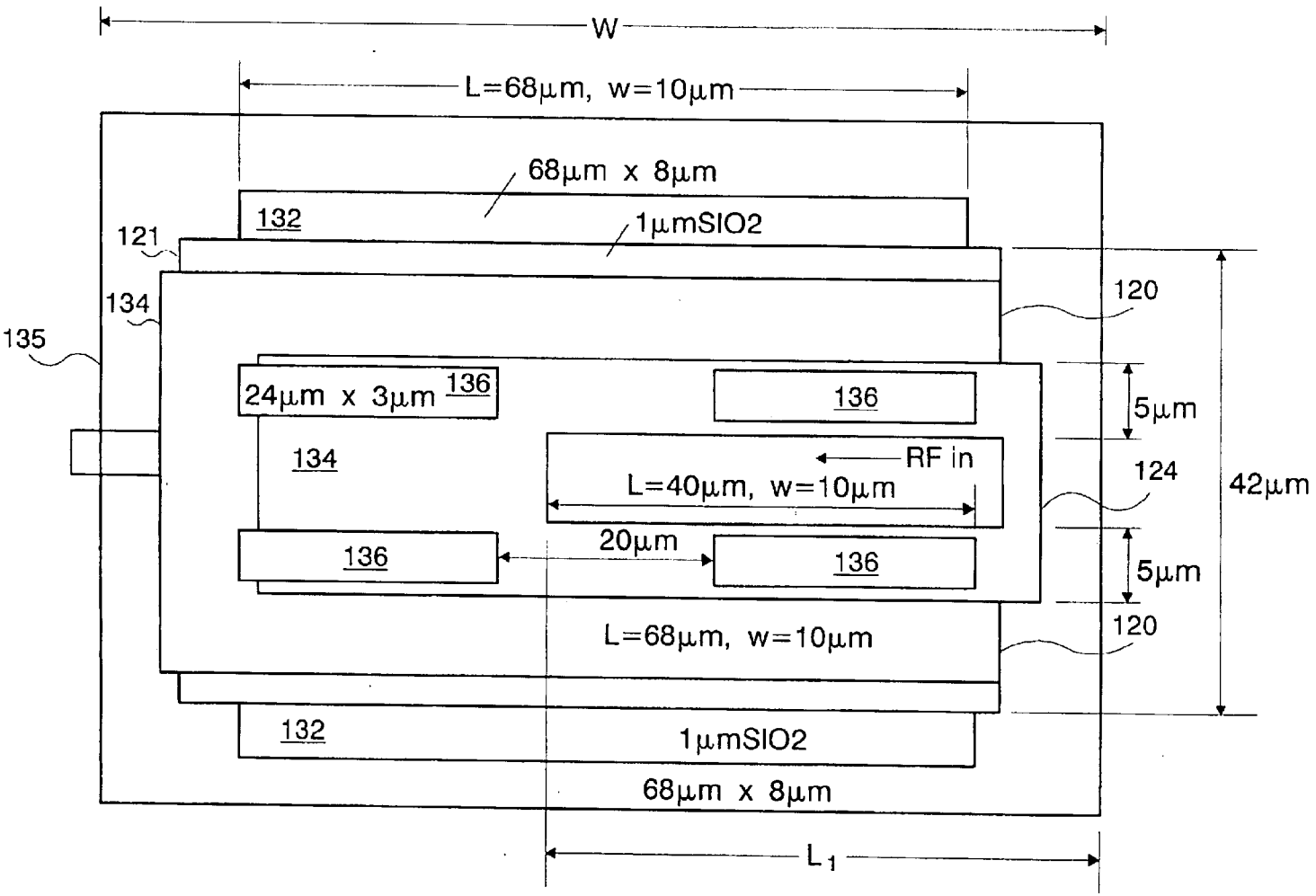
FIG. 4 illustrates a preferred MEMS RF switch where the RF signal line is partly metal and partly dielectric.
Figure 5:
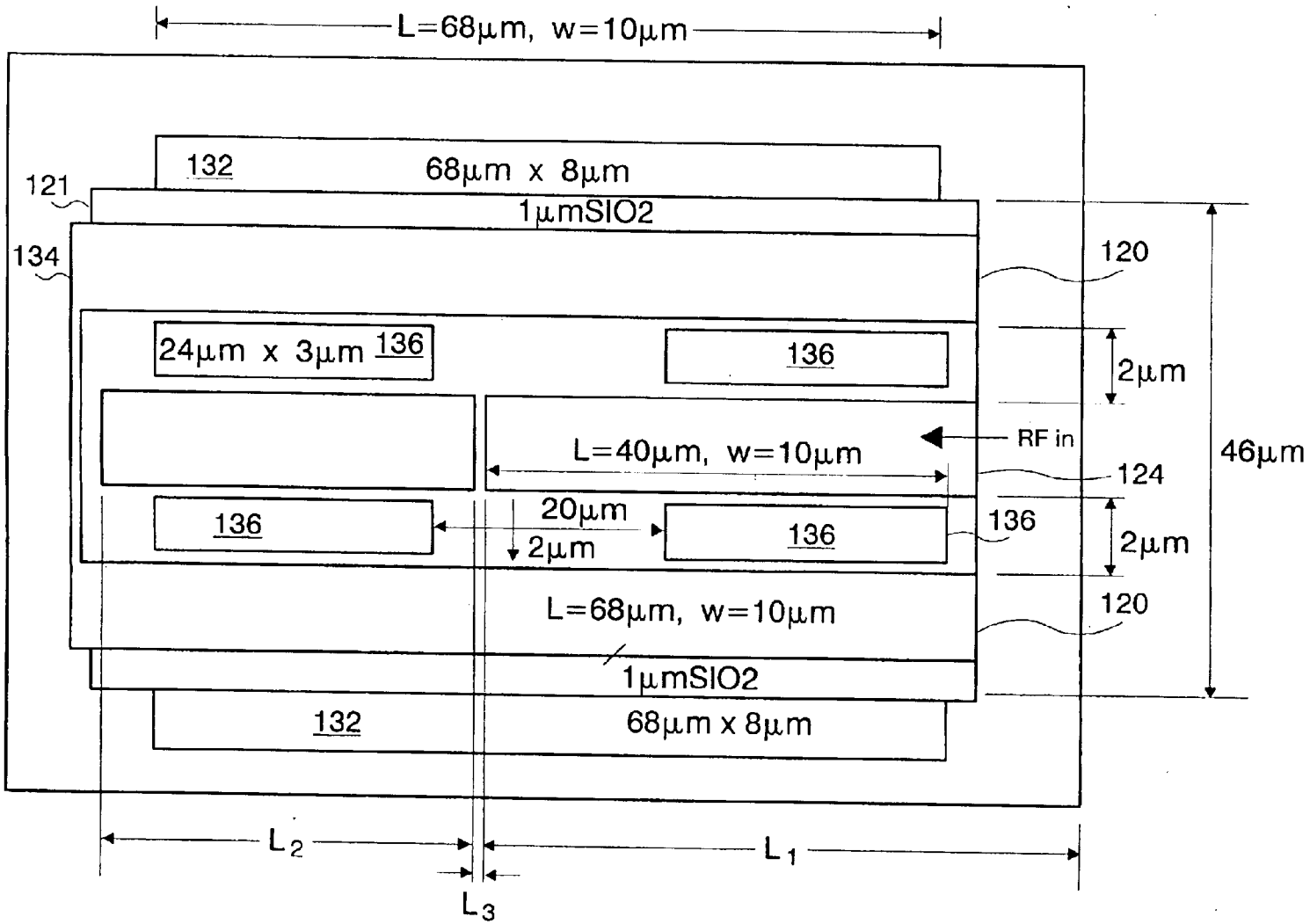

Referring now to FIG. 4, there are shown typical dimensions of a composite metal-insulator-metal beam 121, the dimensions being by way of example only and not to limit the scope or spirit of the present invention. Etch holes 136 are provided within the center part of the beam 121 to make the beam 121 lighter thereby resulting in faster switching times and at the same time will provide better access for etching away the sacrificial material and releasing the beam 121. The upper conductor 124 in this design spans only a portion of the beam length. In other words, upper and lower level portions 104, 102 have a width W and the second electrode 124 (and/or first electrode 112) is aligned in the direction of W and has a first dimension L1 in the direction of W which is less than W. An improved design of the beam 121 is shown in FIG. 5 in which a dummy conductor 138 is used to improve heat dissipation. The dummy conductor is preferably not electrically connected to the upper electrode 124 and upper actuator electrodes 120 and is preferably aligned in the same direction as W and has a length L2, which is smaller than L1. Preferably, there is a slight gap L3, such as 1 micron, between the dummy conductor 138 and the second electrode 124. The dummy conductor 138 provides effective heat dissipation and also provides symmetry in terms of materials for improved mechanical performance.

Figure 6:
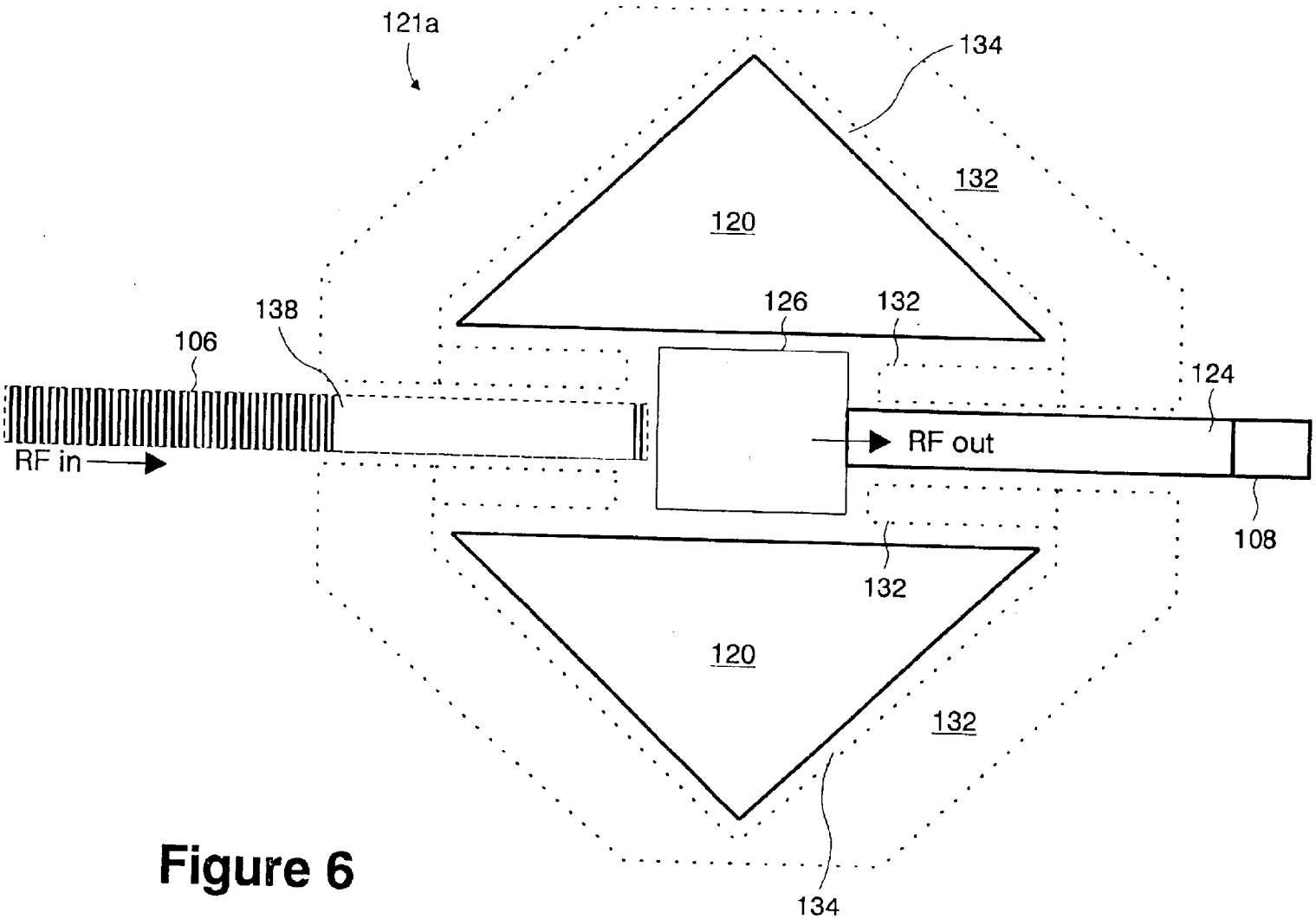
FIG. 6 illustrates another preferred implementation of a RF MEMS switch.

Referring now to FIG. 6, there is shown an alternative design for the beam 121, referred to therein as 121*a*, in which similar reference numerals denote similar features as that shown in the previous Figures. The beam 121*a* is fixed at both ends through the center dummy conductor 138 and RF signal output line 124. The RF signal comes in through line 106 that is at a lower level than the beam 121*a*. When the beam 121*a* is actuated electrostatically through actuator electrodes 120, then it bends down and makes contact through the RF contact 126 and the signal passes through the beam 121*a* and line 108. The area designated by reference numeral 132 in FIG. 6 is the area surrounding the beam 121*a* where the sacrificial material has been etched away and the beam 121*a* is free. The lower level portion 102 is similar to that previously described with regard to FIGS. 1*a*, 1*b*, and 1*c*. This alternative design will offer a lower actuation voltage along with the advantages of the previous designs due to a less stiff anchoring scheme.

Figure 7:
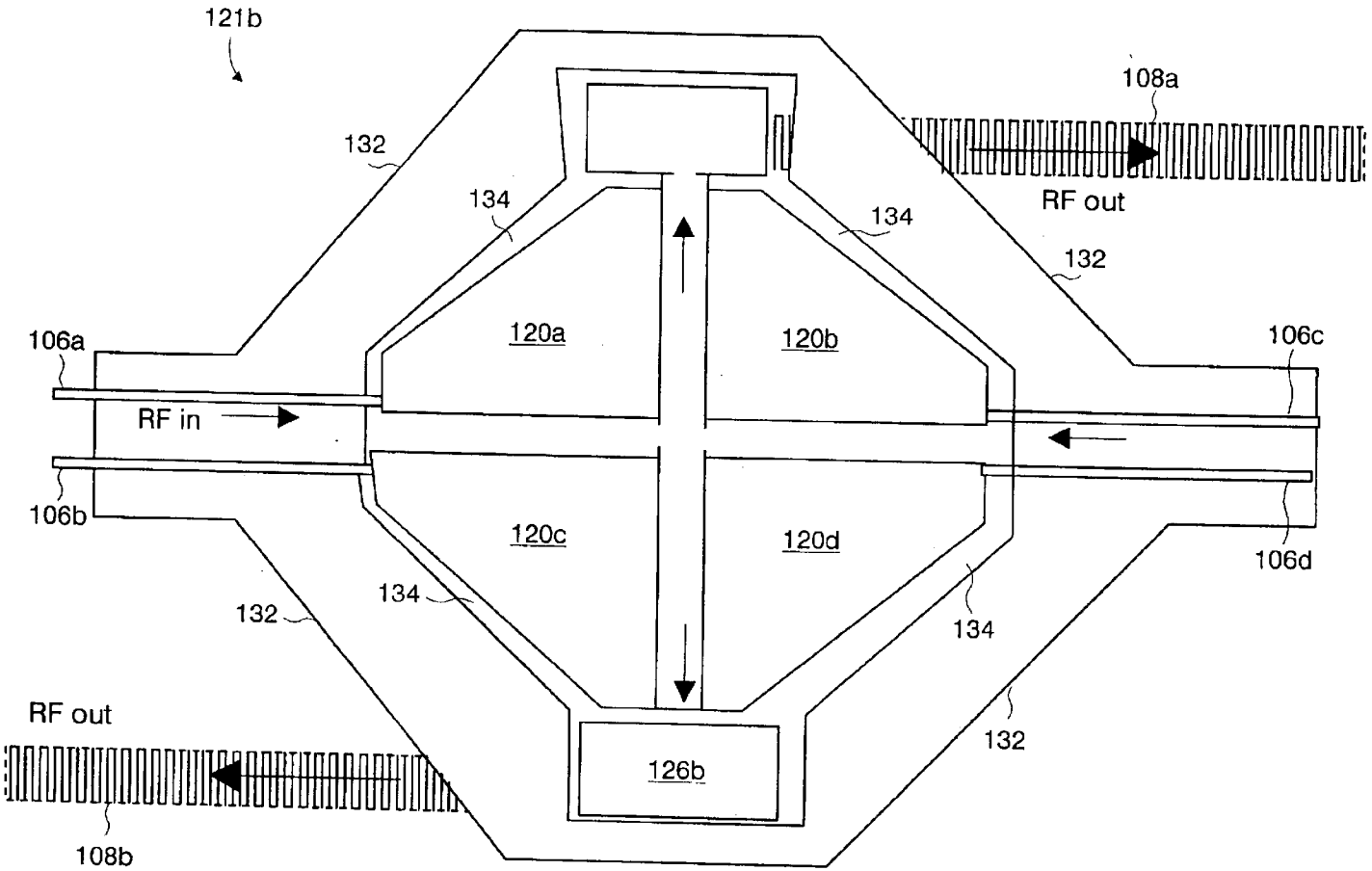
FIG. 7 illustrates yet another preferred implementation of a RF MEMS switch.

Referring now to FIG. 7, there is shown yet another alternative design for the beam 121, referred to therein by reference numeral 121*b*, in which similar reference numerals denote similar features as that shown in the previous Figures. FIG. 7 shows a seesaw movable beam 121*b* upper actuator electrodes 120*a*, 120*b*, 120*c*, and 120*d*. Also provided are RF contacts 126*a*, 126*b* on either side of the anchored beam 121*b*. The beam 121*b* is anchored on through RF inputs 106*a*, 106*b* that run in the center but which are long enough allowing free bending of the beam on either side either of RF contact 126*a* or on the side of contact 126*b*. When a voltage with respect to ground is applied on actuators 120*a* and 120*b*, then the beam 121*b* bends toward contact 126*a*. Contact 126*a* bends down and contacts RF output line 108*a*, thereby allowing the RF signal to pass from beam 121*b* into line 108*a*. When a voltage with respect to ground is applied on actuators 120*c* and 120*d*, then the beam 121*b* bends toward contact 126*b* and the RF signal goes out through output line 126*b*. The lower level portion 102 is similar to that previously described with regard to FIGS. 1*a*, 1*b*, and 1*c*. This alternative configuration, as is the alternative configuration shown in FIG. 6, is also a single contact configuration with a full separation of the DC and RF parts of the signal on the movable part of the switch. The seesaw configuration allows the use of DC actuation voltages of less than 10V to electrostatically bend the beam either toward 126*a*/108*a* or 126*b*/108*b*.

Figure 8:
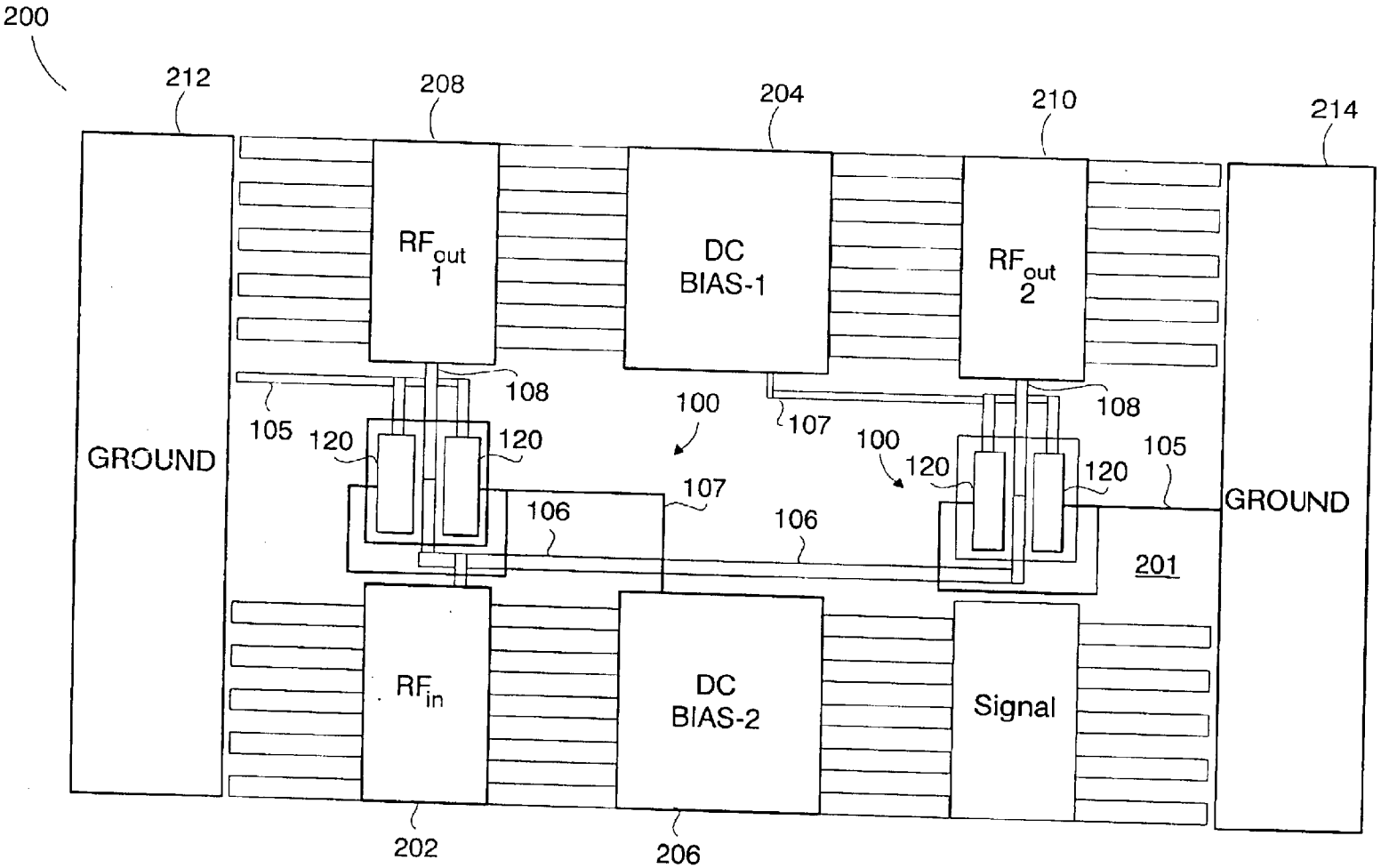
FIG. 8 illustrates a top view of a schematic layout of a single-pole double-throw MEMS RF switch according to a preferred implementation.

Referring now to FIG. 8 there is shown a schematic layout of the electrical connections necessary to achieve a single-pole double-throw or multi-throw switch using any of the switch designs previously described, the single-pole double-throw switch being generally referred to by reference numeral 200. Although switch 200 is shown with 2 single-pole single-throw switches 100, such is shown by way of example only and not to limit the scope or spirit of the present invention. Those skilled in the art will appreciate that a multiple-throw switch can be configured by using multiple single-pole single-throw switches 100 arranged on a substrate 201. Switch 200 has one RF in probe pad 202 connected to RF input lines 106, which input both single-pole single-throw switches 100. Switch 200 also has two DC bias pads 204, 206 each connected to voltage potential lines 107 to actuate separately each single-pole single-throw switch 100. Two RF out pads 208, 210 are provided, each of which are connected to RF output lines 108. Furthermore, two separate ground pads 212, 214 are provided, each of which are connected to voltage potential lines 105. Those skilled in the art will appreciate that by selectively creating an attraction between the upper and lower actuator electrodes 110, 120, preferably by holding the lower actuator electrodes 110 at ground and the upper actuator electrodes 120 at a constant voltage V1, a single-pole, double-throw switch is realized. As discussed above, a multiple-throw switch can be realized by using multiple single-pole single-throw switches 100.

Figure 9:
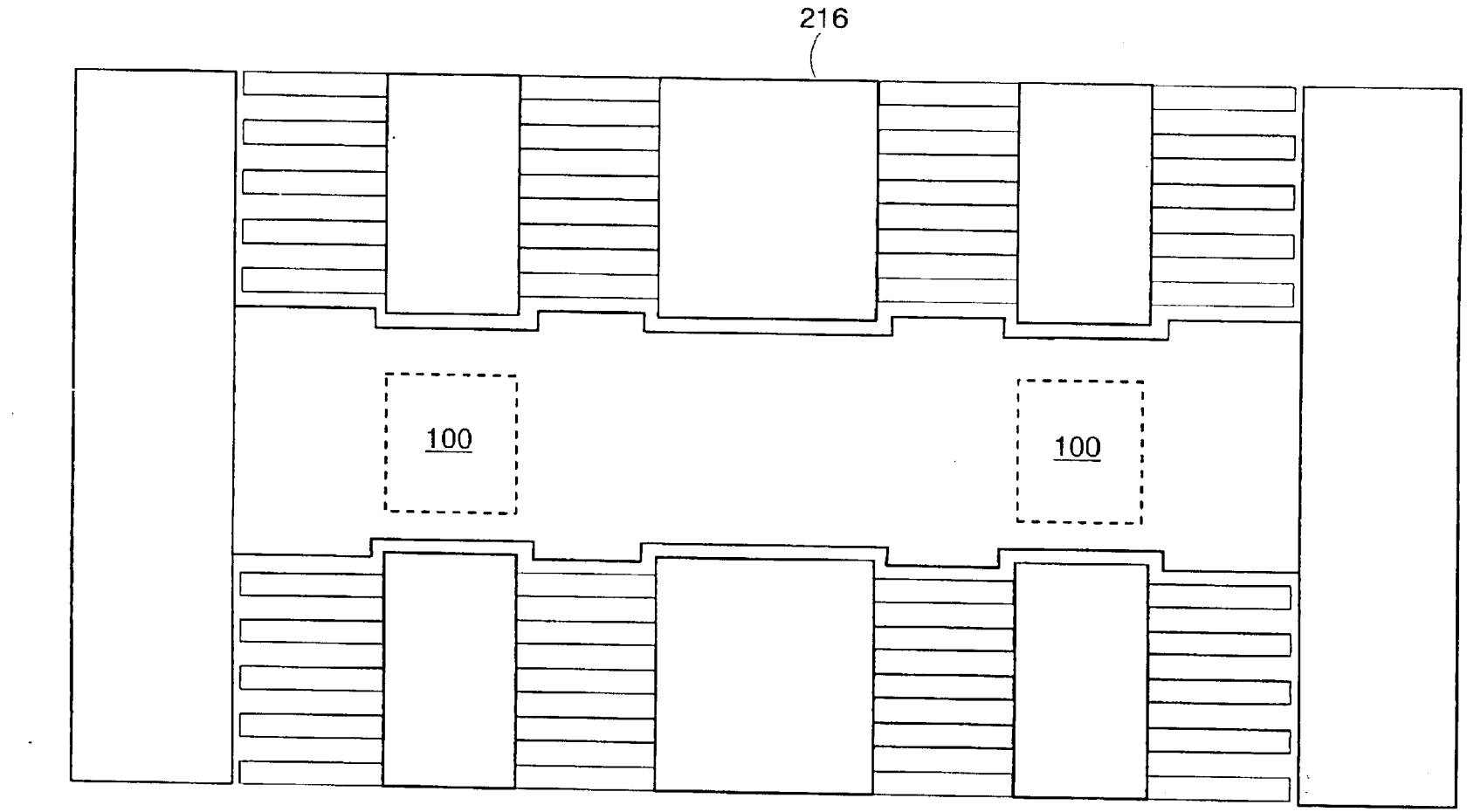
FIG. 9 illustrates a bottom view of the single-pole double-throw MEMS RF switch of FIG. 8.
Figure 10:
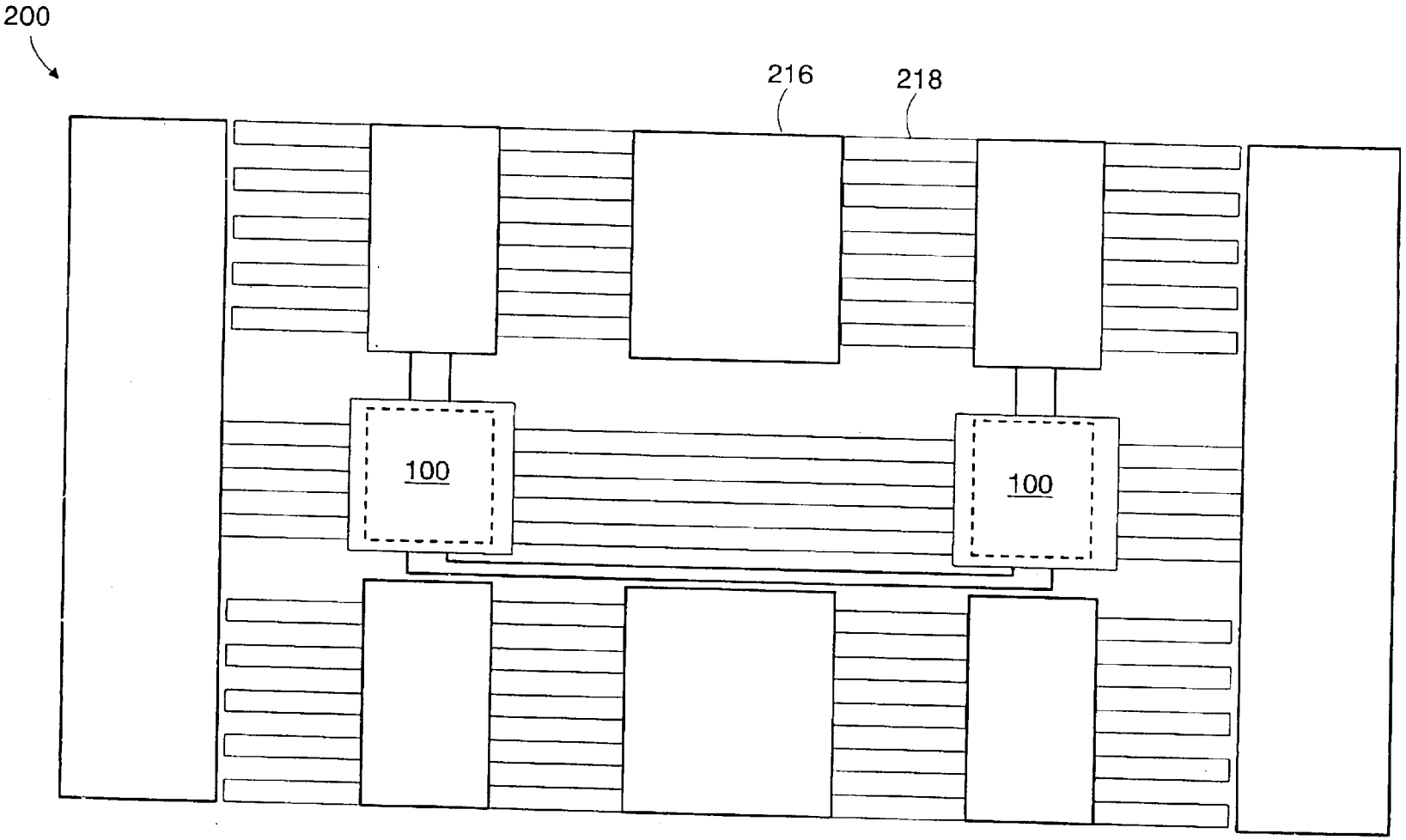
FIG. 10 illustrates an alternative bottom view of the single-pole double-throw MEMS RF switch of FIG. 8.

Referring now to FIG. 9, there is shown a bottom view of the switch 200 of FIG. 8, in which the position of the single-pole single-throw switches 100 are shown as broken lines. A ground plane 216 is provided on a lower surface of the substrate 201, preferably 3 to 4 microns below the single-pole single-throw switches 100. The ground plane 216 terminates the electromagnetic field and allows the single-pole single-throw switches 100 to yield low losses on the order of less than −0.5 dB at @2 GHz. FIG. 10 shows an alternative embodiment for the design of the ground plane 216 for the switch 200 of FIG. 8. In the alternative embodiment, the ground plane 216 is present as a solid block of metal only below each throw of the single-pole single-throw switches 100 and below the RF signal lines. Each solid metal piece is connected to a subsequent metal piece with a set of parallel wires 218.

Figure 11A:
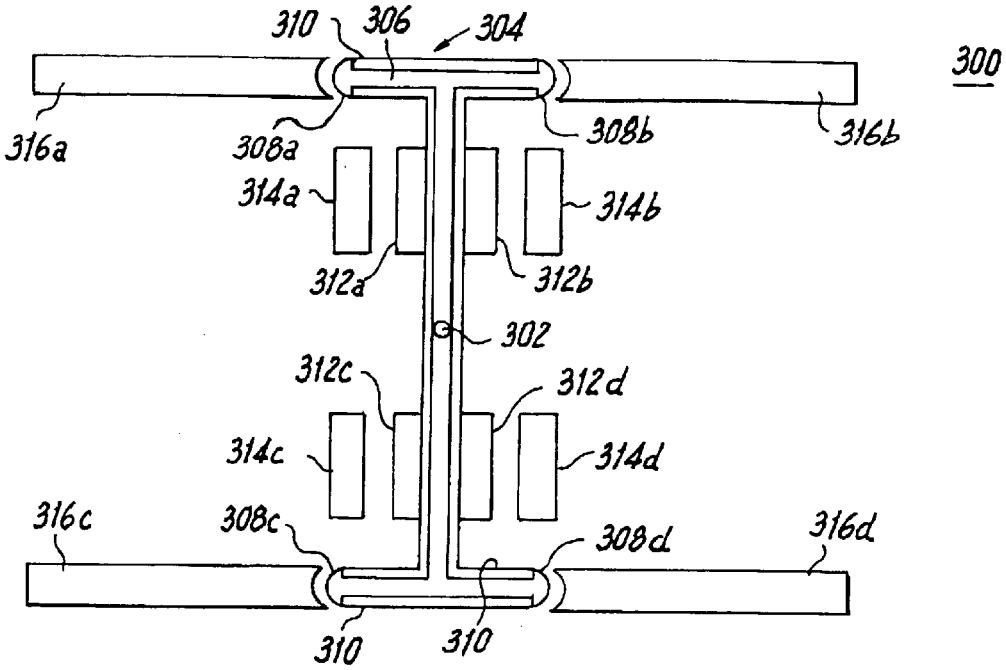
FIG. 11*a* illustrates a schematic view of paired single-pole, single-throw torsional switches having a single contact according to a preferred implementation.
Figure 11B:
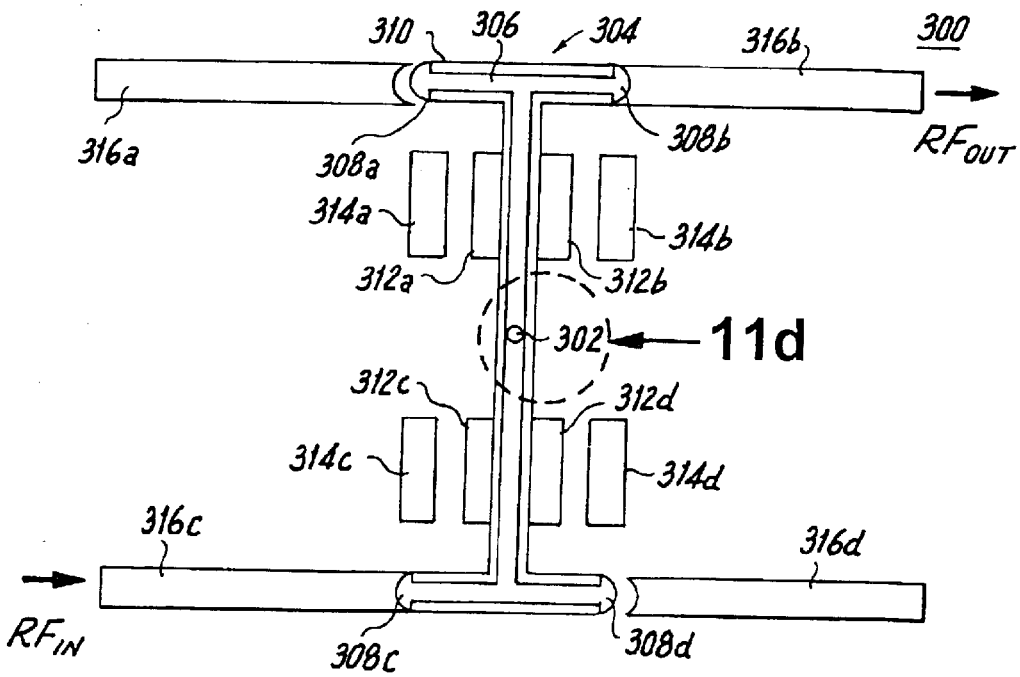
FIG. 11*b* illustrates paired single-pole, single-throw torsional switches of FIG. 11*a* in which path C–B is completed.
Figure 11C:
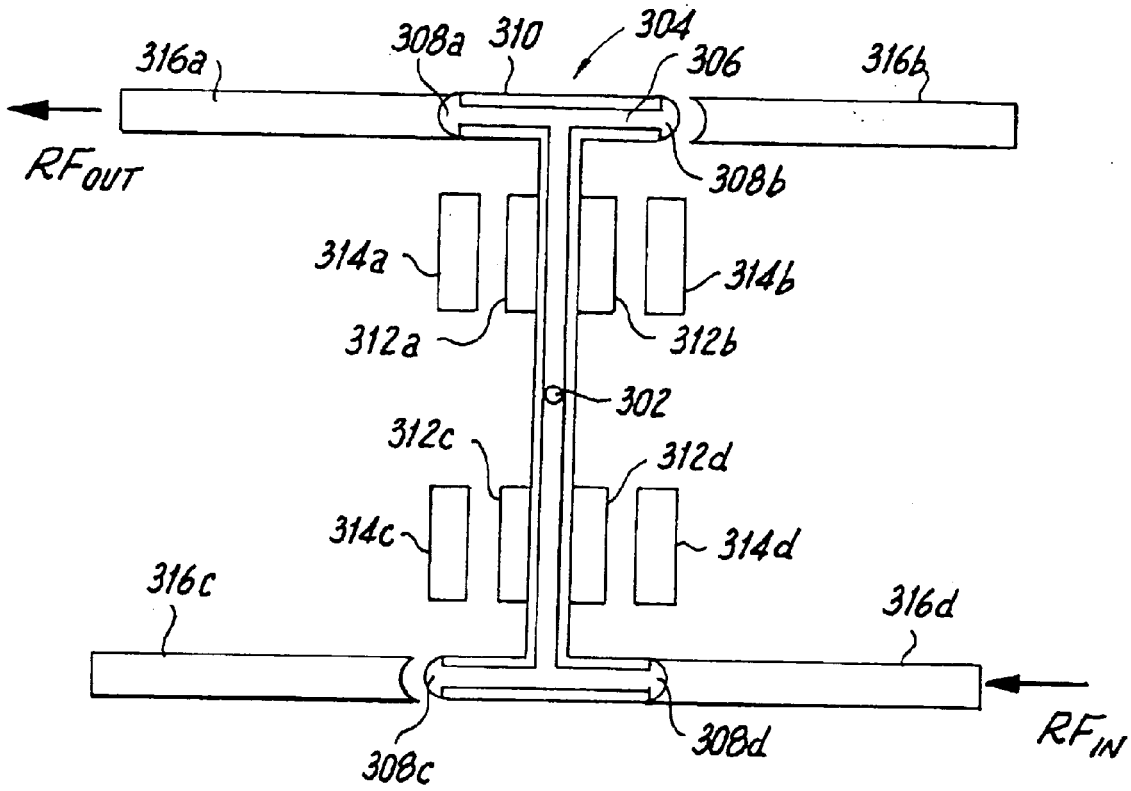
FIG. 11*c* illustrates the paired single-pole, single-throw torsional switches of FIG. 11*a* in which path A–D is completed.
Figure 11D:
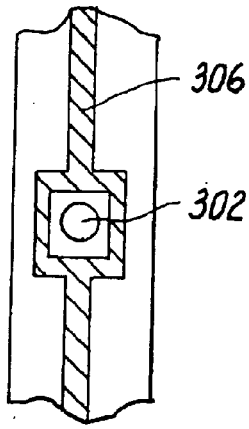
FIG. 11*d* illustrates the structure of the pivot point in greater detail.

Referring now to FIGS. 11*a*, 11*b*, 11*c*, and 12*a* and 12*b*, there is shown alternative designs of a lateral switch with a single contact and a full separation of the DC actuators from the RF signal on the movable part of the beam. The switches of FIGS. 1*a*, 11*b*, 11*c*, and 12*a* and 12*b* are configured as a pair of single-pole, single-throw switches, by way of example only, with the restriction that they cannot both be closed at the same time. Referring only to FIGS. 11*a*, 11*b*, and 11*c*, there is shown switch 300 having RF input lines 316*c*, 316*d* where the RF signal comes in and runs on a movable beam 304, which instead of being movable by way of deflecting, is movable by way of rotation. The beam has an electrode 306 for carrying the RF signal and contacts 308*a*, 308*b*, 308*c*, and 308*d* electrically connected to the electrode 306. The beam 304 further has an insulator 310 disposed about the electrode 306. The bean further has at least one set, and preferably two sets of first actuator electrodes 312*a*, 312*b*, 312*c*, and 312*d*, which are preferably maintained at ground. The switch 300 further has second actuator electrodes 314*a*, 314*b*, 314*c*, and 314*d*, separated by respective air gap 315, which are selectively held at a constant voltage V1. RF input/output lines 316*a*, 316*b*, 316*c*, and 316*d* are also provided.

As shown in FIG. 11*b*, when the second actuator electrodes 314*b* and 314*c* are biased with a DC voltage, the beam rotates such that contacts 308*b* and 308*c* make contact with RF lines 316*b* and 316*c* such that the signal runs from RF line 316*c* to RF line 316*b*. Similarly, as shown in FIG. 11*c*, when the second actuator electrodes 314*a* and 314*d* are biased with a DC voltage, the beam rotates such that contacts 308*a* and 308*d* make contact with RF lines 316*a* and 316*d* such that the signal runs from RF line 316*d* to RF line 316*a*. FIG. 1*d* illustrates a pivot point 302 which is used to supply a DC voltage. It is constructed to wrap around below the beam surface to supply voltage to electrodes 312*c*–312*b* or 312*a*–312*d*.

Figure 12A:
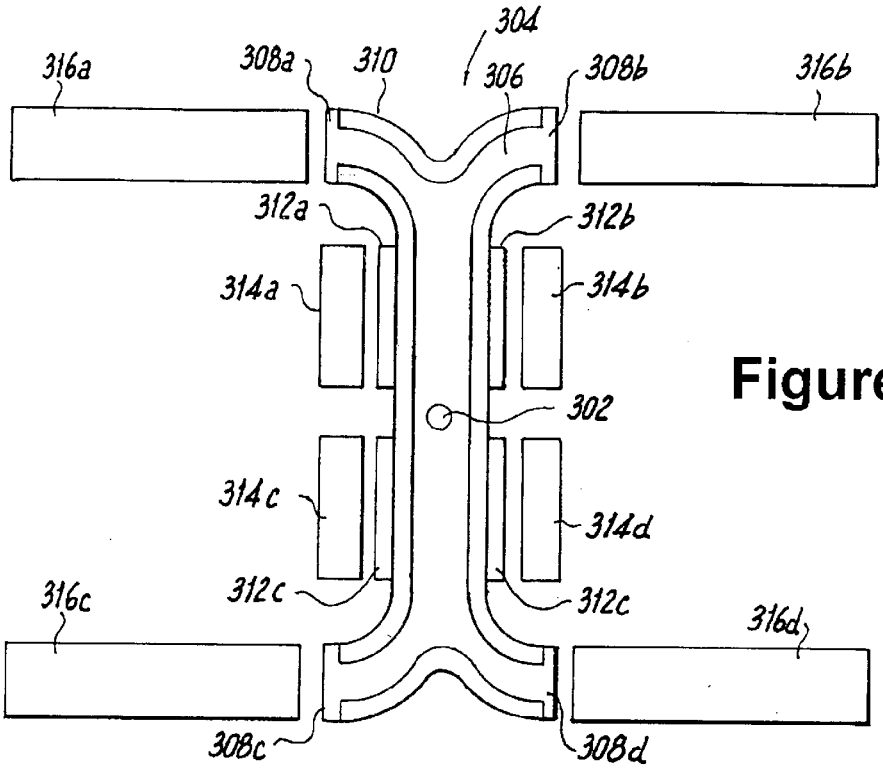
FIG. 12*a* illustrates a schematic view of the paired single-pole, single-throw torsional switches having v-shaped beams with a single contact according to a preferred implementation.
Figure 12B:
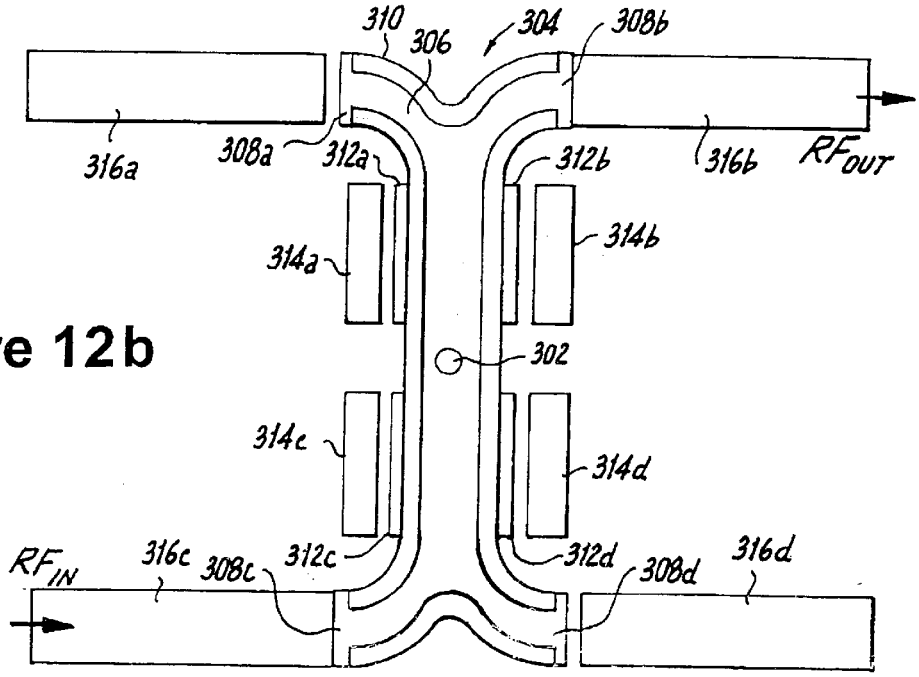
FIG. 12*b* illustrates the paired single-pole, single-throw torsional switch of FIG. 12*a* in which path C–B is completed.

FIGS. 12*a* and 12*b*, show a similar switch, referred to by reference numeral 400 in which similar reference numeral from FIGS. 11*a*, 11*b*, and 11*c* denote similar features. Switch 400 uses a V-shaped beam 402 with a single contact. FIG. 12*b* shows a signal path from RF line 316*c* to RF line 316*b* when the second actuator electrodes 314*b* and 314*c* are biased with a voltage V1.

Therefore, to minimize losses and improve on a MEMS switch linearity, the switches 100, 200, 300, 400 disclosed herein separate entirely the RF signal electrodes from the DC actuators. Another reason for separating the DC actuators of the switch beam from the RF signal beam electrode is the need to design single-pole-multiple-throw switches for transmit/receive or frequency selection wireless applications. Integrating two or N number of switches in parallel provides a multiple throw switch with N number of throws.

Furthermore, the switches of the present invention solve the Joule heating dissipation problem of the prior art switches by using a composite metal-dielectric beam comprised of a metal actuator electrode, a thin layer of dielectric, a metal RF signal electrode and a second metal actuator electrode. A preferred metal is copper but other metals such as aluminum, nickel and their alloys can be used to fabricate the MEMS switch. Another advantage is the presence of a single contact for the RF signal. The RF signal is fed at an upper electrode of a fixed upper beam which, when actuated, is moved, such as by bending down to contact a lower electrode. A single RF contact with the use of appropriate contact materials give a lower contact resistance for the same contact force than a dual-contact metal-to-metal switch for the same contact force. Still another advantage of the switches of the present invention is the ability to fabricate very small gaps between the beam and the lower electrodes. Gaps between 0.1–0.5 microns typically yield actuation voltages of less than 10V. Finally, the switches of the present invention provide for a multi-throw MEMS switch for consumer wireless applications. The multi-throw design has typically one RF signal input and four to five RF signal output for selection of different frequencies and bands in GSM or UMTS system. The design of the multi-throw switch includes design of a ground plane to effectively terminate the electromagnetic field and to minimize RF signal losses within the silicon substrate.

While it has been shown and described what is considered to be preferred embodiments of the invention, it will, of course, be understood that various modifications and changes in form or detail could readily be made without departing from the spirit of the invention.

It is, therefore, intended that the invention be not limited to the exact forms described and illustrated, but should be constructed to cover all modifications that may fall within the scope of the appended claims.

What is claimed is:

1. A single contact microelectromechanical switch comprising:

a first level portion having a first electrode for input or output of a radio frequency signal, at least one first actuator electrode electrically isolated from the first electrode, and a first contact electrically cooperating with the first electrode; and a second level portion having at least a portion separated from the first level portion by an air gap, the second level portion having a deflective beam capable of deflecting into the air gap, the beam having at least one second actuator electrode corresponding to the at least one first actuator electrode, the beam further having a second electrode corresponding to the first electrode for the other of the input or output of the radio frequency signal and a second contact electrically cooperating with the second electrode, the at least one second attractive electrode being electrically isolated from the second electrode;

wherein creation of an electrical attraction between the at least one first and second actuator electrodes causes the beam to deflect into the air gap and to provide an electrical connection between the first and second contacts and their respective first and second electrodes for allowing the input radio frequency signal to one of the first and second electrodes to be output to the other of the first and second electrodes.

2. The microelectromechanical switch of claim 1, wherein the at least one first actuator electrode comprises two first actuator electrodes each of which are electrically isolated from the first electrode and wherein the at least one second actuator electrode comprises two second actuator electrodes, each of the two first actuator electrodes corresponding to a respective second actuator electrode when the beam is deflected into the air gap.

3. The microelectromechanical switch of claim 1, further comprising at least one bumper arranged on the first level portion adjacent the first contact for preventing stiction between the beam and actuators between the first and second contacts when the beam is deflected into the air gap.

4. The microelectromechanical switch of claim 3, wherein the at least one bumper comprises first and second bumpers, each of which is arranged on the first level portion adjacent the first contact for preventing stiction between beam and actuators when the beam is deflected into lower air gap.

5. The microelectromechanical switch of claim 1, wherein the creation of an electrical attraction between the first and second actuator electrodes comprises means for maintaining one of the first and second actuator electrodes at a ground state and the other of the first and second actuator electrodes energized with an applied voltage.

6. The microelectromechanical switch of claim 1, wherein the beam further having a plurality of access holes formed therein for facilitating creation of the air gap.

7. The microelectromechanical switch of claim 1, wherein at least one of the first and second actuator electrodes are rectangular and wherein at least a portion of the first and second actuator electrodes correspond with each other across the air gap.

8. The microelectromechanical switch of claim 7, wherein each of the first and second actuator electrodes comprises two first and second actuator electrodes, each of which are rectangular and disposed on both sides of their corresponding first and second electrodes.

9. A single contact microelectromechanical switch comprising:

at least one pair of actuator electrodes;

at least one input electrode and at least one output electrode for input and output, respectively, of a radio frequency signal; and a beam movable by an attraction between the at least one pair of actuator electrodes, the movable beam having at least a portion electrically connected to the at least one input electrode and to the at least one output electrode when moved by the attraction between the at least one pair of actuator electrodes to make an electrical connection between the at least one input and output electrodes;

wherein the at least one pair of actuator electrodes are electrically isolated from each of the at least one input and output electrodes.

* * * * *